US011965709B2

(12) United States Patent
Vanek

(10) Patent No.: US 11,965,709 B2
(45) **Date of Patent: *Apr. 23, 2024**

(54) STRUCTURES FOR FIREARMS

(71) Applicant: Vantac Technologies LLC, Darby, MT (US)

(72) Inventor: Joede Thomas Vanek, Darby, MT (US)

(73) Assignee: Vantac Technologies LLC, Darby, MT (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/109,179

(22) Filed: Feb. 13, 2023

(65) Prior Publication Data

US 2023/0384055 A1 Nov. 30, 2023

Related U.S. Application Data

(62) Division of application No. 16/905,696, filed on Jun. 18, 2020, now Pat. No. 11,592,263.

(60) Provisional application No. 62/863,626, filed on Jun. 19, 2019.

(51) Int. Cl.

| | |
|---|---|
| ***F41C 23/14*** | (2006.01) |
| ***F41C 23/04*** | (2006.01) |
| *F41C 23/06* | (2006.01) |

(52) U.S. Cl.

CPC ..... *F41C 23/14* (2013.01); *F41C 23/04* (2013.01); *F41C 23/06* (2013.01)

(58) Field of Classification Search

CPC ..... F41A 3/84; F41A 3/70; F41A 3/12; F41A 3/94; F41A 3/80; F41A 25/12; F41C 23/14; F41C 23/04; F41C 23/06

USPC ..... 42/1.06, 71.01–74; 89/198

See application file for complete search history.

(56) References Cited

U.S. PATENT DOCUMENTS

| | | | | |
|---|---|---|---|---|
| 3,344,712 | A | 10/1967 | Colby | |
| 3,442,042 | A | 5/1969 | Van Tyle | |
| 4,327,626 | A | 5/1982 | McQueen | |
| 6,839,998 | B1 | 1/2005 | Armstrong | |
| 7,793,453 | B1 | 9/2010 | Sewell, Jr. et al. | |
| 7,984,580 | B1 | 7/2011 | Giauque et al. | |
| 8,596,185 | B1 | 12/2013 | Soong et al. | |
| 8,800,189 | B2 * | 8/2014 | Fitzpatrick | F41C 23/04 42/71.01 |
| 8,991,088 | B1 | 3/2015 | Young | |
| 9,488,435 | B1 * | 11/2016 | Roberts | F41C 23/14 |
| 9,612,083 | B2 | 4/2017 | Cottle et al. | |
| 9,746,281 | B2 | 8/2017 | Wilson et al. | |
| 10,451,380 | B2 | 10/2019 | Vanek et al. | |
| 10,527,385 | B1 | 1/2020 | Schumacher | |
| 10,928,159 | B2 | 2/2021 | Vanek et al. | |
| 10,989,236 | B2 | 4/2021 | Cross | |

(Continued)

*Primary Examiner* — Michael D David

(74) *Attorney, Agent, or Firm* — Locke Lord LLP; Daniel J. Fiorello

(57) ABSTRACT

A buffer tube for a firearm can include a body defining an interior cavity for receiving a buffer spring and a rail disposed on and/or formed from the outer surface of the body. The rail can include one or more pin holes configured to receive a pin of a stock to lock the stock in a position. The buffer tube can also include a slide bar channel defined through at least a portion of the rail and configured to allow a slide bar to slide therein relative to the one or more pin holes to urge a pin out of a respective pin hole and/or to block a pin from being received by the pin holes.

20 Claims, 14 Drawing Sheets

(56) References Cited

U.S. PATENT DOCUMENTS

| | | | | |
|---|---|---|---|---|
| 11,262,158 | B2 | 3/2022 | Cahill | |
| 11,365,952 | B2 * | 6/2022 | Hopkins | F41C 23/14 |
| 11,740,041 | B2 * | 8/2023 | Vanek | F41C 23/20 89/199 |
| 2003/0101631 | A1 | 6/2003 | Fitzpatrick et al. | |
| 2010/0205846 | A1 | 8/2010 | Fitzpatrick et al. | |
| 2011/0283584 | A1 | 11/2011 | Walters | |
| 2014/0259848 | A1 | 9/2014 | Chvala | |
| 2015/0176944 | A1 | 6/2015 | Kupanoff | |
| 2016/0069636 | A1 | 3/2016 | Gomirato et al. | |
| 2016/0327361 | A1 | 11/2016 | Roberts et al. | |
| 2017/0205190 | A1 | 7/2017 | Jen et al. | |
| 2017/0356718 | A1 | 12/2017 | Johnson | |
| 2018/0003459 | A1 | 1/2018 | Miller et al. | |
| 2018/0347939 | A1 | 12/2018 | Keller et al. | |
| 2019/0017774 | A1 | 1/2019 | Vanek et al. | |
| 2019/0195595 | A1 | 6/2019 | Kielsmeier et al. | |
| 2019/0204043 | A1 | 7/2019 | Vanek et al. | |
| 2020/0200505 | A1 | 6/2020 | Brown, Jr. | |
| 2020/0400403 | A1 | 12/2020 | Vanek | |
| 2021/0199404 | A1 | 7/2021 | Vanek et al. | |

* cited by examiner

100
G
119
101
111
105
117
107
107
141
100
105
G
100

101
111
105
SECTION G-G 107
117
107
111b
111c
100
111a
115
119
111
100
141
105
101

100

100

L
L
100
111b
111c
111a
141

100
111
111c
111b
111a
115
SECTION L-L 100
141

Section I-I

STRUCTURES FOR FIREARMS

CROSS-REFERENCE TO RELATED APPLICATIONS

This application is a continuation of U.S. patent application Ser. No. 16/905,696, filed Jun. 18, 2020, which claims priority to and the benefit of U.S. Provisional Application No. 62/863,626, filed Jun. 19, 2019, the entire contents of each are herein incorporated by reference in their entirety.

BACKGROUND

1. Field

This disclosure relates to firearms, more specifically to structures for firearms.

2. Description of Related Art

Existing buffer tube systems are inert metal tubes with an interior spring to work the rifle bolt. Such conventional methods and systems have generally been considered satisfactory for their intended purpose. However, there is still a need in the art for improved structures for firearms. The present disclosure provides a solution for this need.

SUMMARY

A buffer tube for a firearm can include a body defining an interior cavity for receiving a buffer spring and a rail disposed on and/or formed from the outer surface of the body. The rail can include one or more pin holes configured to receive a pin of a stock to lock the stock in a position. The buffer tube can also include a slide bar channel defined through at least a portion of the rail and configured to allow a slide bar to slide therein relative to the one or more pin holes to urge a pin out of a respective pin hole and/or to block a pin from being received by the pin holes.

The rail can extend radially outward from the body, for example. The one or more pin holes can include a plurality of pin holes defined in a radial direction in the rail.

The slide bar channel can open at an outward face of the rail at least along a portion of an axial length thereof such that the slide bar channel connects a plurality (e.g., all) of the pin holes. The slide bar channel opens at the outward face of the rail at least between a first pin hole and a last pin hole such that the slide bar channel connects all of the pin holes.

In certain embodiments, the buffer tube can include the slide bar disposed within the slide bar channel and configured to slide relative to the rail. The slide bar can be configured to allow a pin to enter into the one or more pin holes in a first position. The slide bar can be configured to urge a pin out of the one or more pin holes and/or to block a pin from entering the one or more pin holes when moved from the first position toward a second position.

In certain embodiments, the slide bar can include one or more teeth that define one or more pin pockets to receive a pin therein to allow a pin to enter into the one or more pin holes when the slide bar is in the first position. The one or more teeth can include a plurality of teeth defining a pin pocket for each of the one or more pin holes, for example. The one or more teeth can include a ramp face such that when the slide bar is moved in a direction (e.g., toward the second position) that causes a pin and the ramp face to contact, the ramp face urges the pin radially outward of the respective pin hole.

In certain embodiments, the buffer tube can include a slide bar biasing member disposed between the slide bar and the rail and/or the body to bias the slide bar to the first position. In certain embodiments, the rail can include a trough defined therein. The one or more pin holes can be disposed within the trough. The trough can be configured to limit a position of the pin of the stock.

In accordance with at least one aspect of this disclosure, a stock system for a firearm can include any suitable embodiment of a buffer tube disclosed herein, e.g., as described above. The stock system can include any suitable embodiment of a slide bar disclosed herein, e.g., as described above, disposed within the slide bar channel and configured to slide relative to the rail.

The system can include an actuator assembly having an actuator operatively connectable or connected to the slide bar to allow a user to move the slide bar from the first position to the second position by moving the actuator from an unactuated position to an actuated position when connected to the slide bar. The system can include a slide bar biasing member disposed between the slide bar and the rail and/or the body to bias the slide bar toward the first position and thus biasing the actuator toward an unactuated position.

In certain embodiments, the actuator assembly can include a blocking member configured to be moved between a blocking position such that the actuator is not moveable toward the actuated position and an unblocking position such that the actuator is moveable to the actuated position. The actuator assembly can include a block biasing member configured to bias the blocking member to the blocking position.

In certain embodiments, the actuator and the blocking member can be configured to be accessible and actuatable from both sides of a grip of the firearm such that the actuator assembly is usable by a right handed user or a left handed user. In certain embodiments, the actuator and the blocking member can be actuatable by a thumb of a user's gripping hand without the user having to remove the same hand from a grip of the firearm and/or without removing a finger of the same hand from a trigger of the firearm.

In certain embodiments, the actuator can include one or more blocking member channels configured to receive a blocking post of the blocking member when the blocking member is in the unblocking position. The actuator can include a connector member configured to connect to or connected to the slide bar to allow the slide bar to be pulled by the actuator.

In certain embodiments, the system can include a mounting plate configured to be secured to the firearm by a castle nut. The mounting plate can be configured to attach to or is attached to the actuator assembly to mount the actuator assembly to the firearm.

In certain embodiments, the system can include a stock slideably mountable to or slideably mounted to the buffer tube and configured to move between a collapsed position and an extended position. The system can also include a pin disposed in the stock and biased in a direction that is radially inward to the buffer tube such that the pin is biased to a locked position where the pin is inserted into one of the one or more pin holes preventing the stock from sliding relative to the buffer tube, and an unlocked position where the pin is outside of the one or more pin holes and configured to slide with the stock such that the stock is allowed to slide relative to the buffer tube. The system can include one or more stock springs disposed between the buffer tube and the stock and configured to bias a the stock to the extended position.

In accordance with at least one aspect of this disclosure, a structure for a firearm can include a body configured to attach to or forming part of the firearm, a rail disposed on or formed from an outer surface of the body, the rail comprising one or more pin holes configured to receive a pin of a stock to lock the stock in a position, a slide bar channel defined through at least a portion of the rail and configured to allow a slide bar to slide therein relative to the one or more pin holes to urge a pin out of a respective pin hole and to block a pin from being received by the pin holes.

These and other features of the embodiments of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figures 1A, 1B, 1C, 1D, 1E:
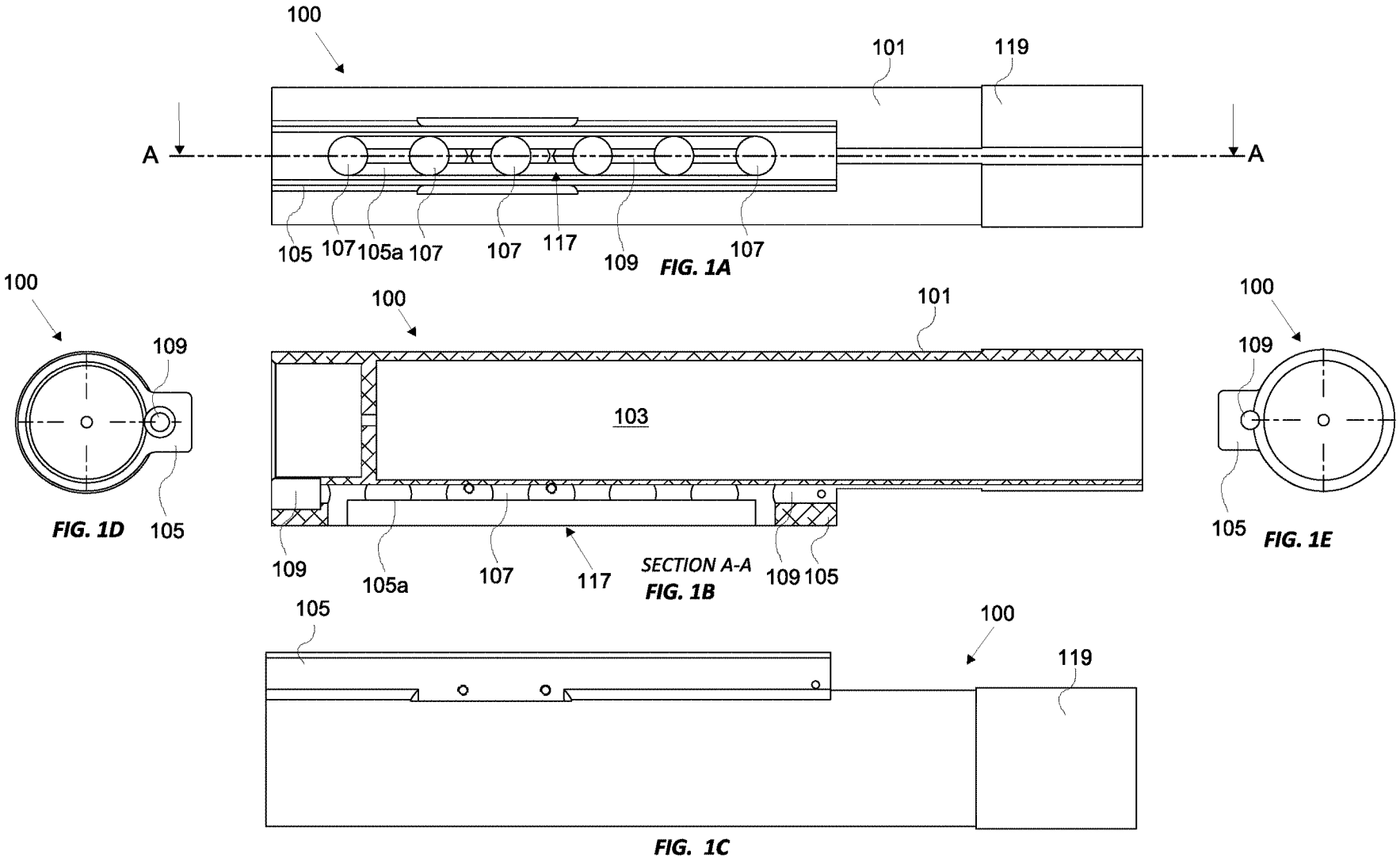
FIG. 1A is a plan view of an embodiment of a buffer tube in accordance with this disclosure.
FIG. 1B is a cross-sectional view of the embodiment of FIG. 1A along line A-A in a direction into the page.
FIG. 1C is a side elevation view of the embodiment of FIG. 1A.
FIG. 1D is a rear elevation view of the embodiment of FIG. 1A.
FIG. 1E is a front elevation view of the embodiment of FIG. 1A.

Reference will now be made to the drawings wherein like reference numerals identify similar structural features or aspects of the subject disclosure. For purposes of explanation and illustration, and not limitation, an illustrative view of an embodiment of a buffer tube in accordance with the disclosure is shown in FIGS. 1A and 1*s* designated generally by reference character 100. Other embodiments and/or aspects of this disclosure are shown in FIGS. 1B-4.

Referring to FIGS. 1A-1E, a structure (e.g., buffer tube 100) for a firearm can include a body 101 configured to attach to or form part of a firearm, e.g., as shown. A buffer tube 100 can define an interior cavity 103 for receiving a buffer spring (not shown). The buffer tube 100 can include a rail 105 disposed on and/or formed from the outer surface of the body 101. The rail 105 can include one or more pin holes 107 (e.g., six as shown) configured to receive a pin (e.g., as shown in FIG. 2C) of a stock (e.g., as shown in FIGS. 2A-2M) to lock the stock in a position. The buffer tube 100 can also include a slide bar channel 109 defined through at least a portion of the rail 105.

Referring additionally to FIGS. 1F-1M, the slide bar channel 109 can be configured to allow a slide bar 111 to slide therein relative to the one or more pin holes 107 to urge a pin out of a respective pin hole 107 and/or to block a pin 107 from being received by the pin holes 107. The slide bar channel 109 can include any suitable shape and/or size, and can extend through an entire length of the rail 105, for example.

The rail 105 can extend radially outward from the body 101, for example. The one or more pin holes 107 can include a plurality of pin holes 107 (e.g., six as shown) defined in a radial direction (e.g., relative to a centerline axis of the body 101) in the rail 105. Any suitable number of pin holes 107 is contemplated herein (e.g., corresponding to any suitable number of discrete positions of a stock).

The slide bar channel 109 can open at an outward face 105*a* of the rail at least along a portion of an axial length (e.g., along a direction of axis A-A) thereof such that the slide bar channel 109 connects a plurality (e.g., all) of the pin holes 107. In certain embodiments, the slide bar channel 109 can open at the outward face 105*a* of the rail 105 at least between a first pin hole 107 (e.g., the furthest right in FIG. 1A) and a last pin hole 107 (e.g., the furthest left in FIG. 1A) such that the slide bar channel 109 connects all of the pin holes 107.

Figures 1F, 1G, 1H, 1I, 1J:
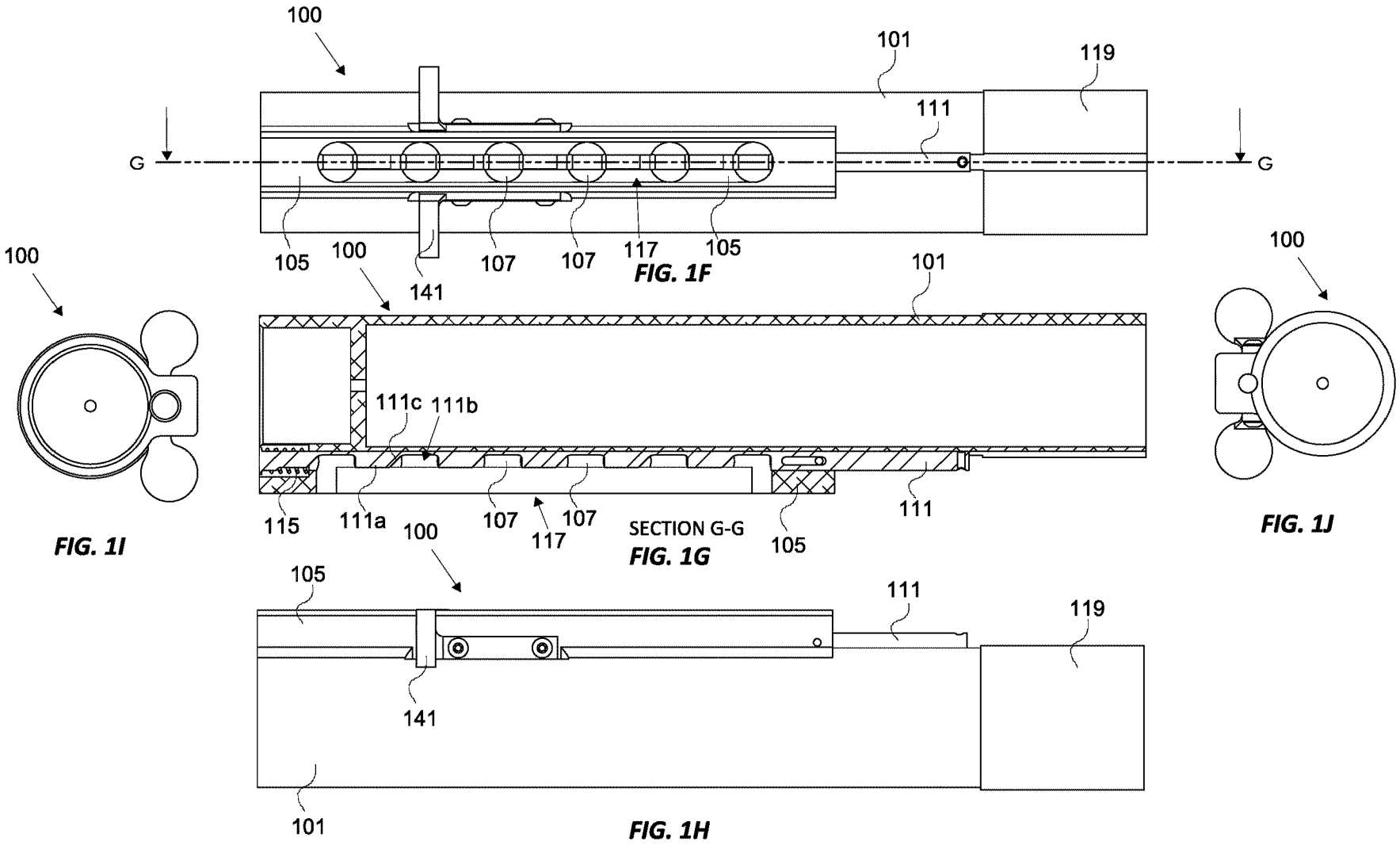
FIG. 1F is a plan view of the embodiment of a buffer tube of FIG. 1, shown including an embodiment of a slide bar slidably disposed in a rail of the buffer tube in accordance with this disclosure, and also shown include an embodiment of a spring stop assembly mounted to the rail in accordance with this disclosure, wherein the slide bar is in a first position in accordance with this disclosure.
FIG. 1G is a cross-sectional view of the embodiment of FIG. 1F along line G-G into the page.
FIG. 1H is a side elevation view of the embodiment of FIG. 1F.
FIG. 1I is a rear elevation view of the embodiment of FIG. 1F.
FIG. 1J is a front elevation view of the embodiment of FIG. 1F.
Figures 1K, 1L, 1M:
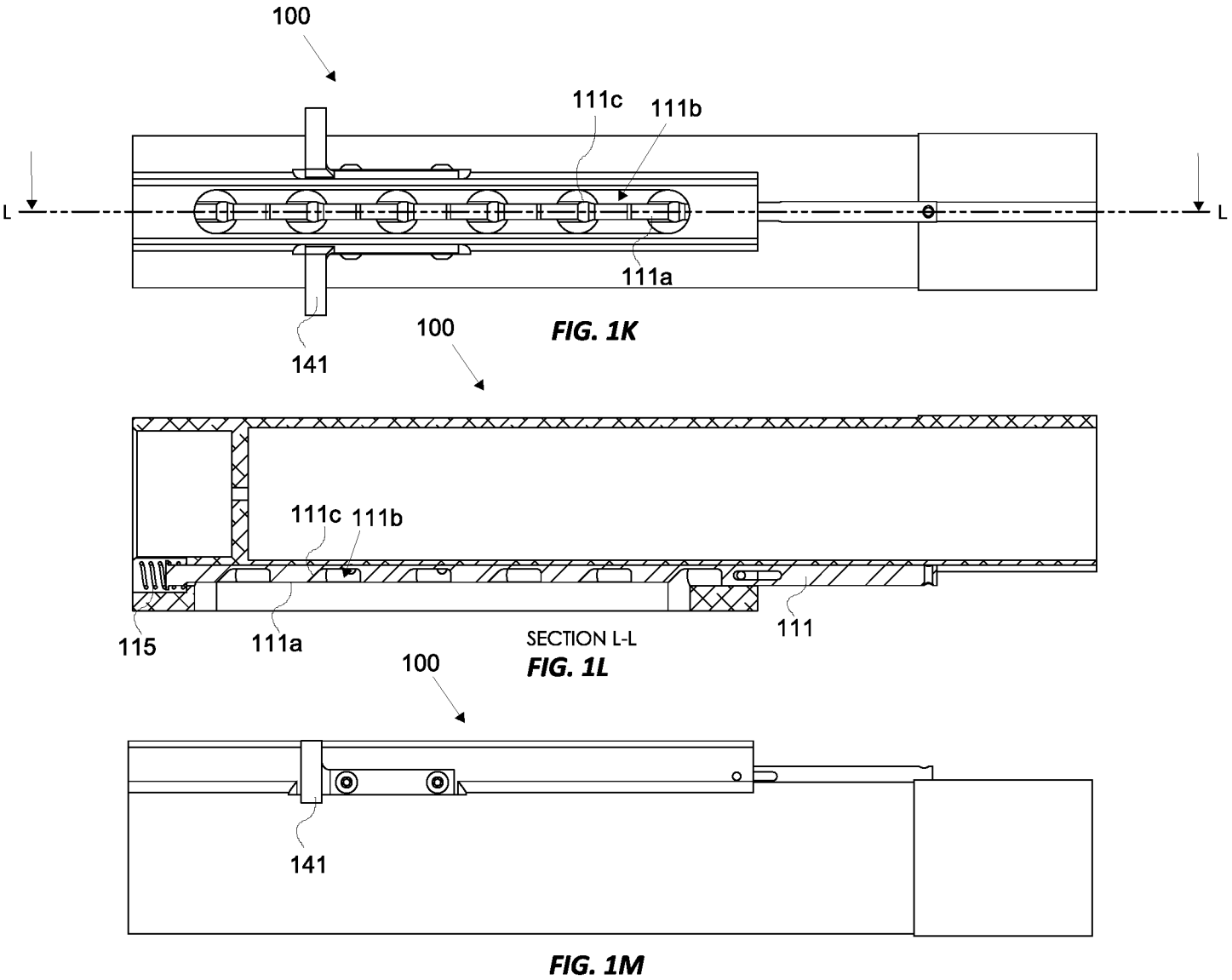
FIG. 1K is a plan view of the embodiment of a buffer tube of FIG. 1, shown including an embodiment of a slide bar slidably disposed in a rail of the buffer tube in accordance with this disclosure, and also shown include an embodiment of a spring stop assembly mounted to the rail in accordance with this disclosure, wherein the slide bar is in a second position in accordance with this disclosure.
FIG. 1L is a cross-sectional view of the embodiment of FIG. 1F along line L-L into the page.
FIG. 1M is a side elevation view of the embodiment of FIG. 1F.

In certain embodiments, the buffer tube 100 can include the slide bar 111, e.g., as shown in FIGS. 1F-1M disposed within the slide bar channel 109 and configured to slide relative to the rail 105. The slide bar 111 can be configured to allow a pin (e.g., pin 113 as shown in FIG. 2C) to enter into the one or more pin holes 107 in a first position (e.g., as shown in FIGS. 1F-1J). The slide bar 111 can be configured to urge a pin (e.g., 113) out of the one or more pin holes 107 and/or to block a pin (e.g., 113) from entering the one or more pin holes 107 when moved from the first position (as shown in FIGS. 1F-1J) toward a second position (e.g., as shown in FIGS. 1K-1M).

In certain embodiments, the slide bar 111 can include one or more teeth 111*a* that define one or more pin pockets 111*b* to receive a pin (e.g., 113) therein to allow a pin (e.g., 113) to enter into the one or more pin holes 107 when the slide bar 111 is in the first position (e.g., as shown in FIGS. 1F-1J and FIGS. 2C and 2D). As shown, in certain embodiments, the one or more teeth 111*a* can include a plurality of teeth 111*a* defining a pin pocket 111*b* for each of the one or more pin holes 107, for example. The one or more teeth 111*a* can include a ramp face 111*c* such that when the slide bar 111 is moved in a direction (e.g., toward the second position as shown in FIGS. 1K-1M) that causes a pin (e.g., 113) and the ramp face 111*c* to contact, the ramp face 111*c* urges the pin (e.g., 113) radially outward of the respective pin hole 107 (e.g., as shown in FIGS. 2G and 2H).

In certain embodiments, the buffer tube 100 can include a slide bar biasing member 115 (e.g., a coiled spring as shown) disposed between the slide bar 111 and the rail 105 and/or the body 101 to bias the slide bar to the first position (e.g., as shown in FIG. 1G). The slide bar biasing member 115 can be configured to fit within a portion of the slide bar channel 109 (e.g., a rear portion thereof as shown). In certain embodiments, e.g., as shown, the slide bar 111 can include an extension portion (e.g., a larger diameter portion, e.g., a flange) at an end thereof to capture the slide bar biasing member 115 within the slide bar channel 109 between the slide bar 111 can the rail 105 and/or the body 101. Any suitable biasing member, position, and/or number thereof are contemplated herein.

In certain embodiments, the rail 105 can include a trough 117 defined therein. The one or more pin holes 107 can be disposed within the trough 117, e.g., as shown. The trough 117 can be configured to limit a position of the pin (e.g., 113) of the stock, e.g., as shown in FIG. 2C (e.g., forward limit) and 2J (e.g., rearward limit).

The body 101 can include any suitable shape (e.g., tubular, having a circular or other suitable cross-sectional shape). The body 101 can include any other suitable features (e.g., threads 119), as appreciated by those having ordinary skill in the art.

Figure 2A:
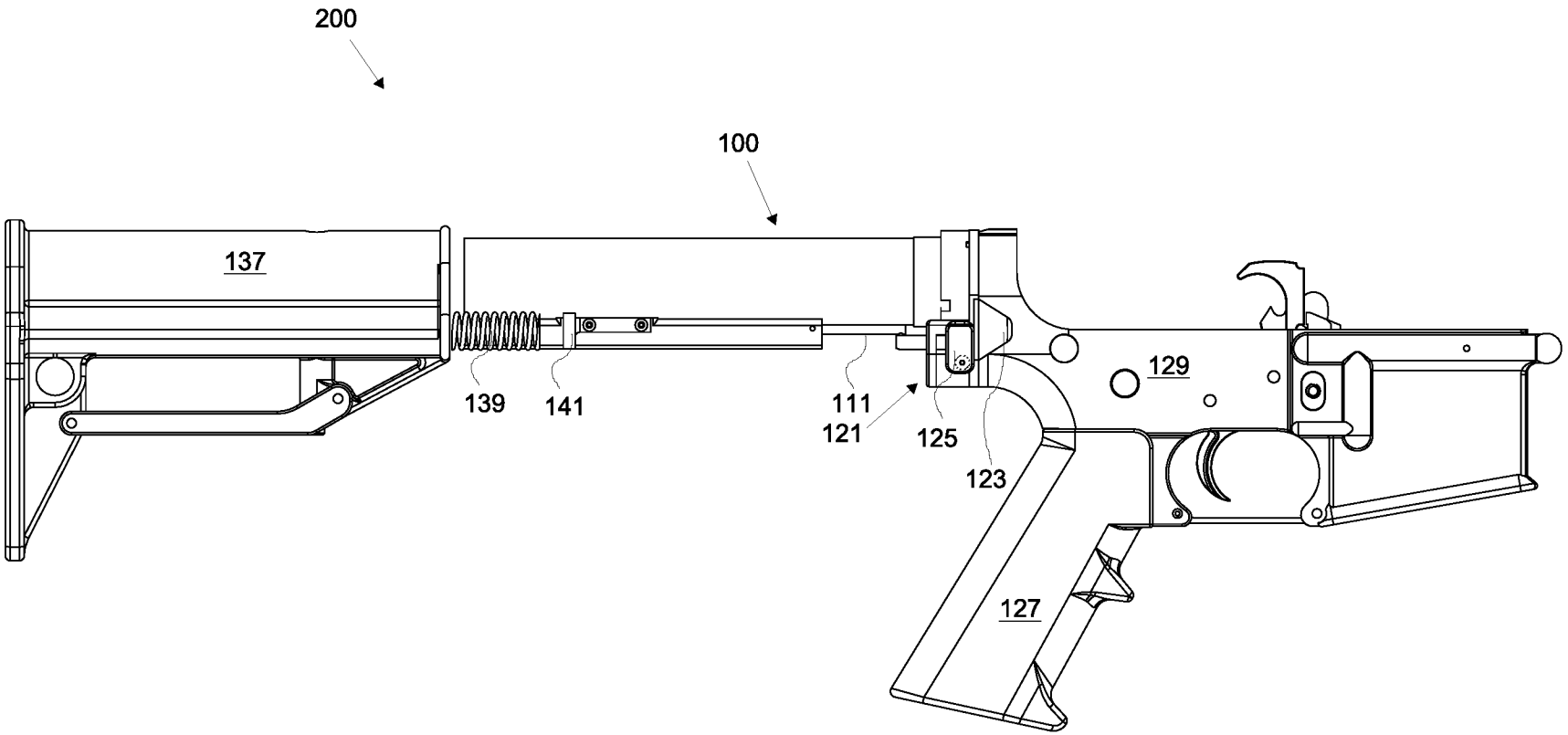
FIG. 2A is a side elevation view of an embodiment of a stock system in accordance with this disclosure, shown mounted to an embodiment of a lower receiver of a firearm and shown partially exploded.
Figure 2B:
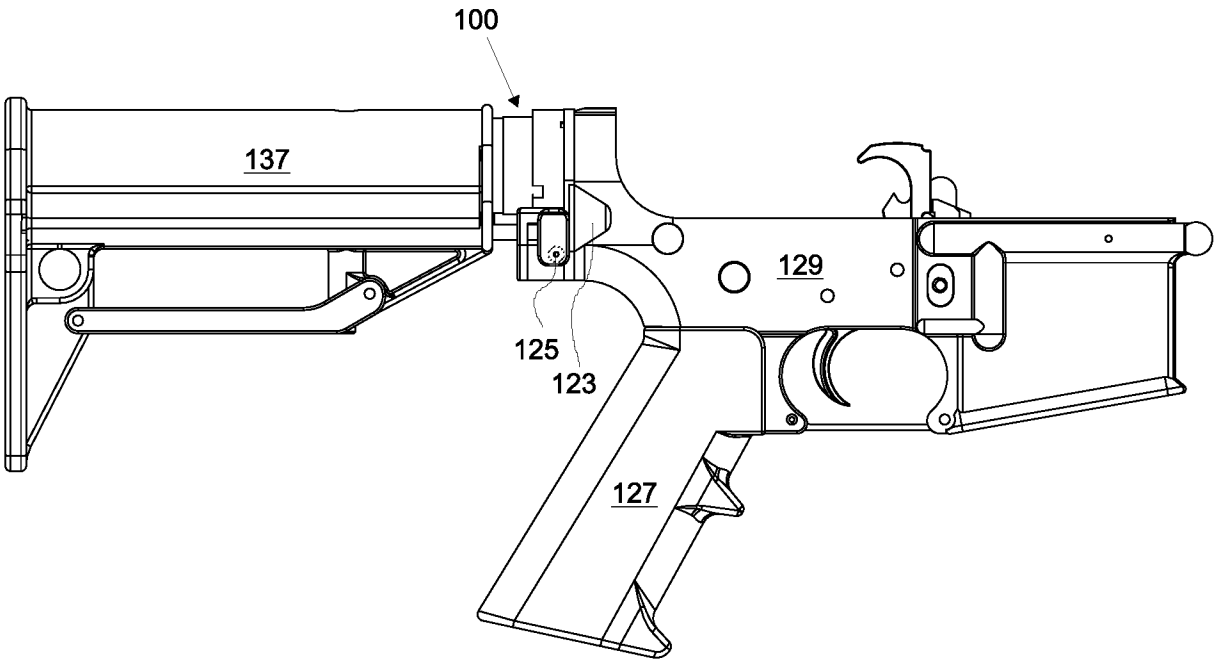
FIG. 2B is a side elevation view of the embodiment system of FIG. 2A, showing an embodiment of a stock of the stock system in a collapsed position and shown having the actuator in an unactuated position.
Figure 2D:
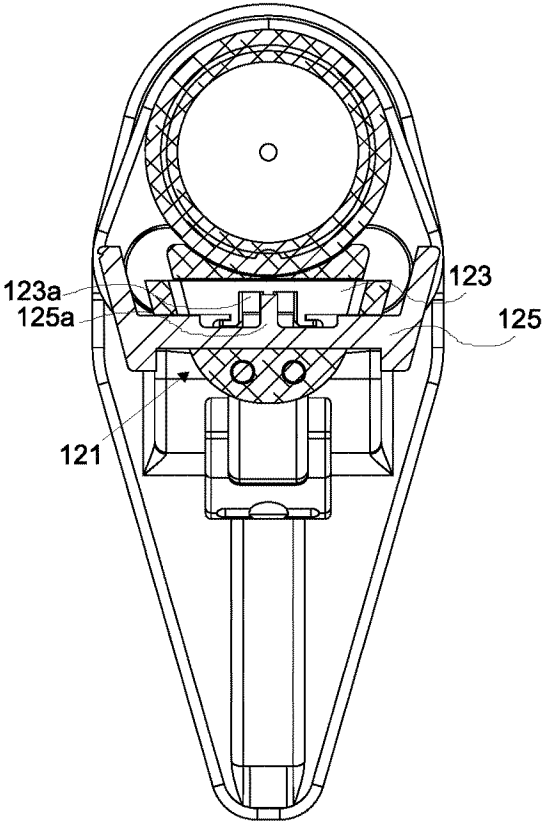
FIG. 2D is a cross-sectional view of an embodiment of FIG. 2D, showing an embodiment of a blocking member in a blocking position preventing an embodiment of an actuator from moving.
Figure 2C:
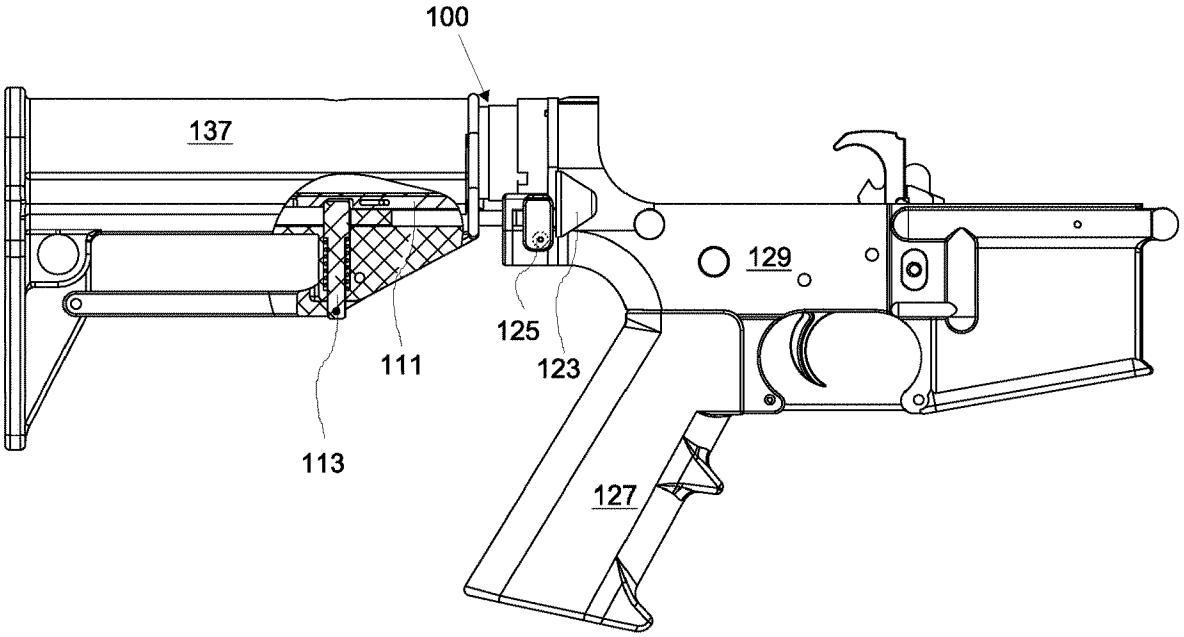
FIG. 2C is a side elevation view of the embodiment system of FIG. 2B, showing a partial cross-sectional view and illustrating a locked position of the pin.
Figure 2F:
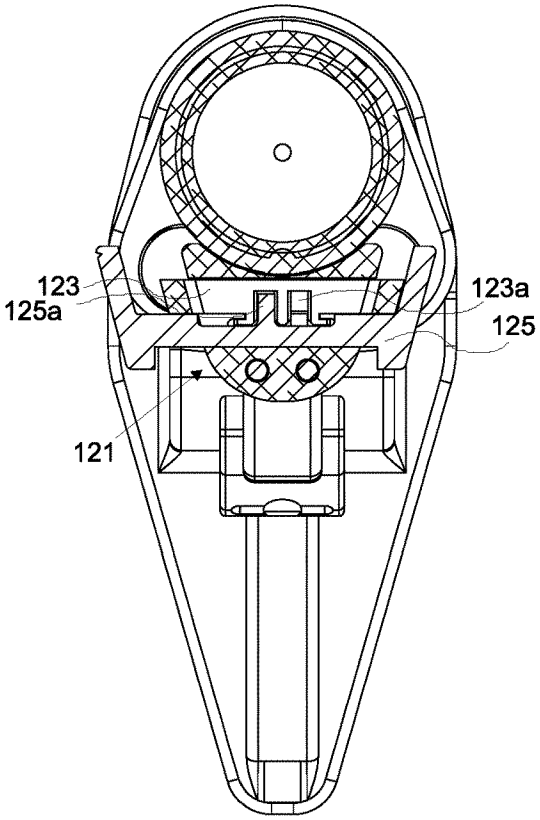
FIG. 2F is a cross-sectional view of an embodiment of FIG. 2D, showing the blocking member in an unblocking position allowing the actuator to move forward.
Figure 2E:
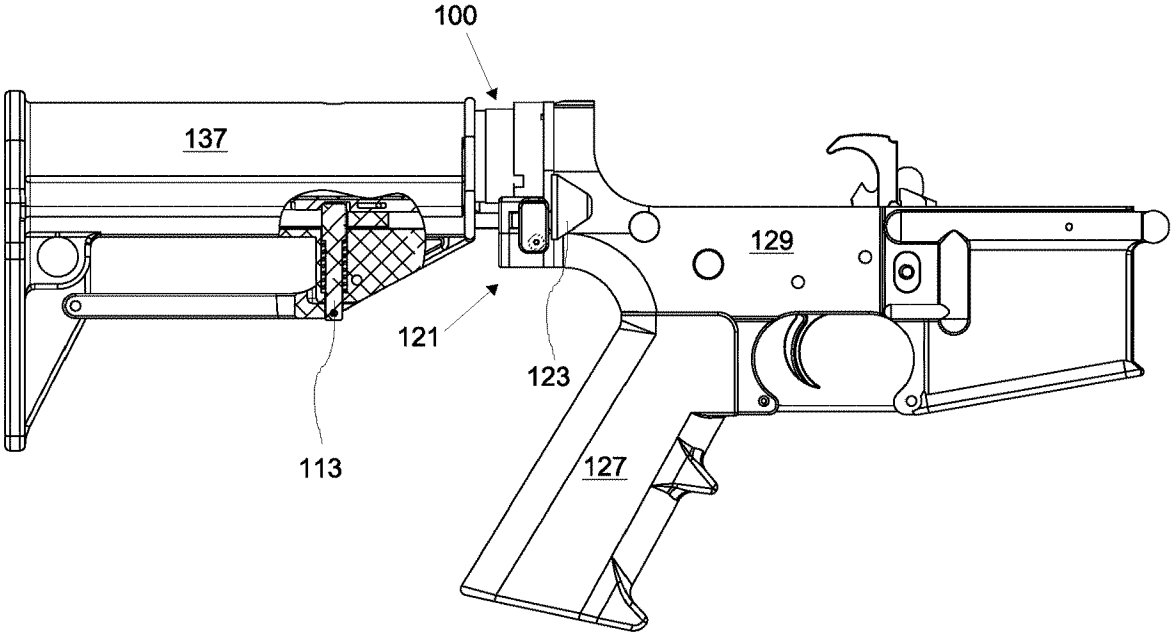
FIG. 2E is a side elevation view of the embodiment system of FIG. 2D, showing the blocking member moved to an unblocking position.
Figure 2G:
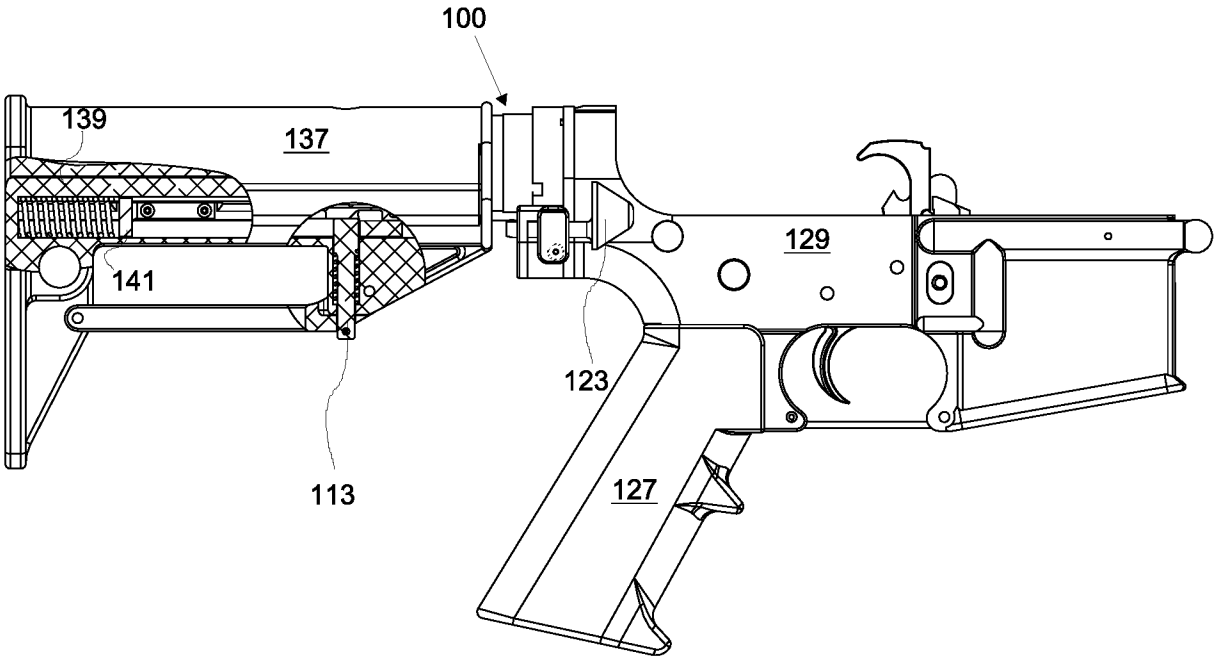
FIG. 2G is a side elevation view of the embodiment system of FIG. 2F, shown having the actuator in an actuated position, thereby moving the slide bar to the second position and the pin to the unlocked position, and showing a partial cross-sectional view illustrating an unlocked position of the pin and an embodiment of a spring assembly biasing the stock to an extended position.
Figure 2H:
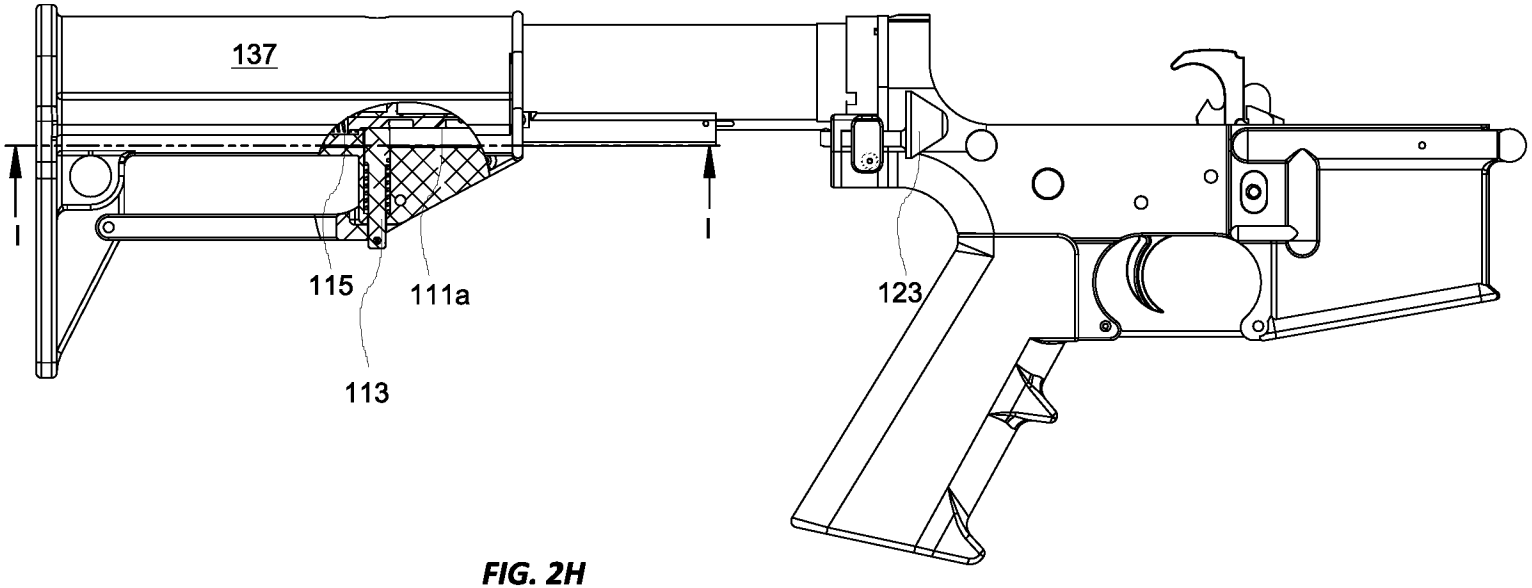
FIG. 2H is a side elevation view of the embodiment system of FIG. 2G, shown having the actuator in an actuated position and the stock moved to a fully extended position such that the pin contacts an aft end of a trough of a rail.
Figure 2I:
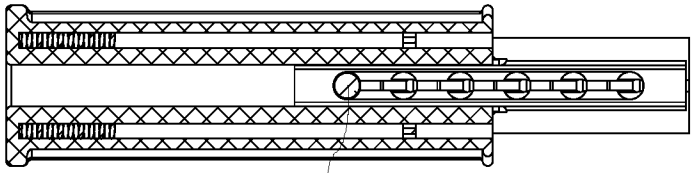
FIG. 2I is a cross-sectional plan view of the embodiment as shown in FIG. 2H, taken through line I-I.
Figure 2J:
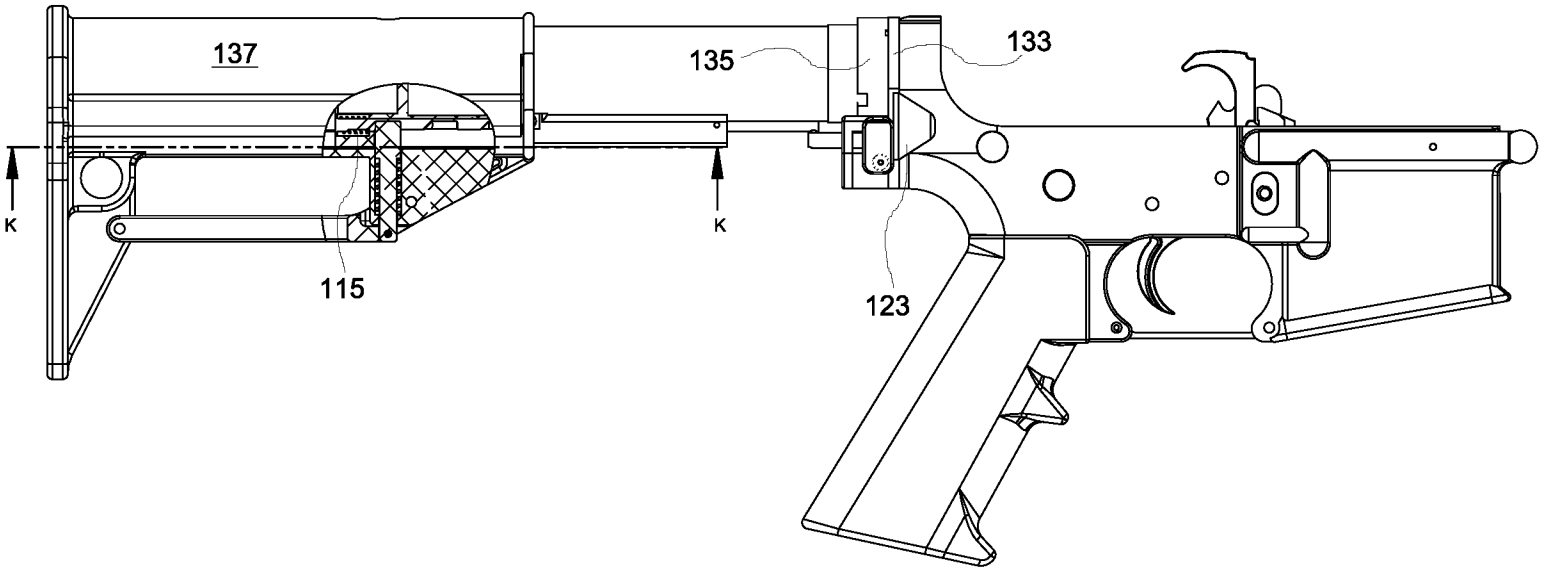
FIG. 2J is a side elevation view of the embodiment system of FIG. 2H, shown having the actuator in an unactuated position such that the slide bar is in the first position and such that the pin is in a locked position in accordance with this disclosure.
Figure 2K:
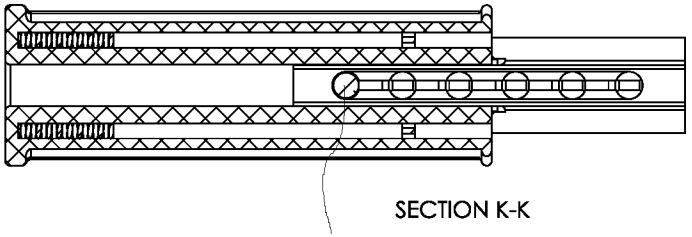
FIG. 2K is a cross-sectional plan view of the embodiment as shown in FIG. 2I, taken through line K-K.
Figure 2L:
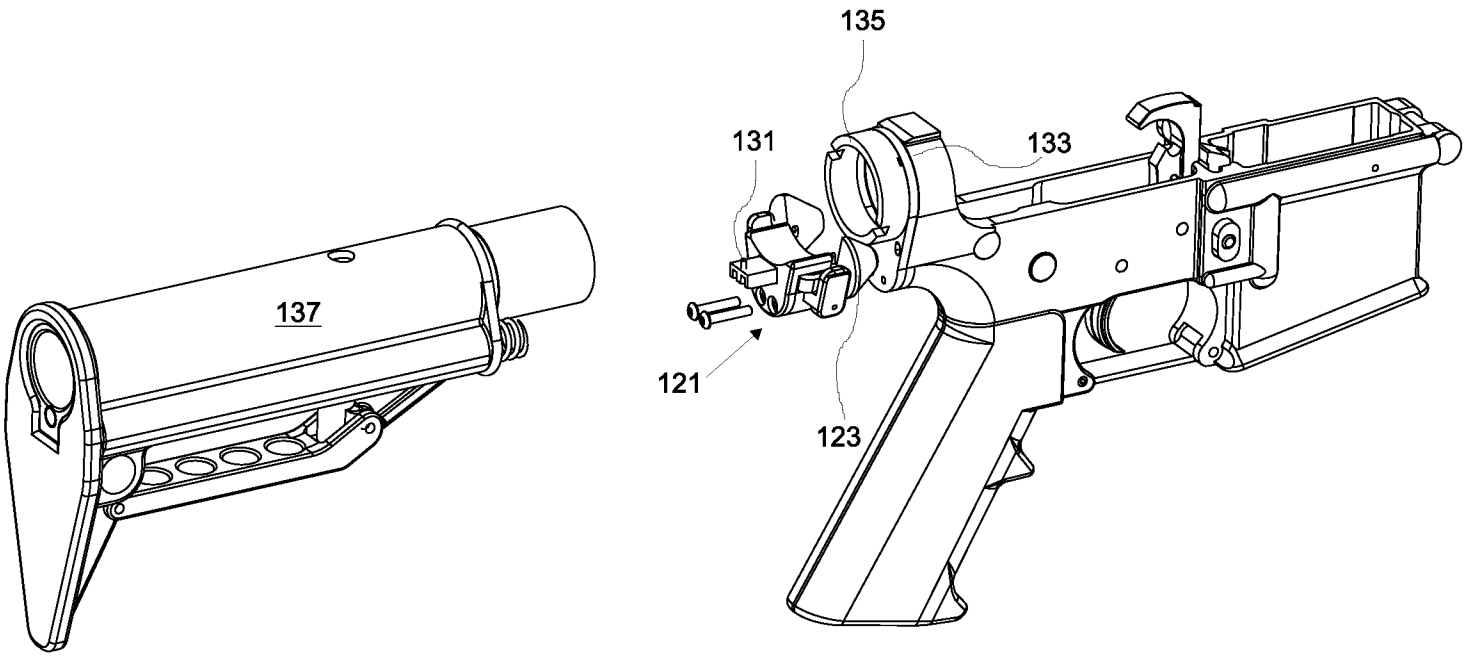
FIG. 2L is a partial isometric view of the embodiment of FIG. 2A, showing an embodiment of an actuator assembly exploded from the lower receiver and in isolation from the buffer tube.
Figure 2N:
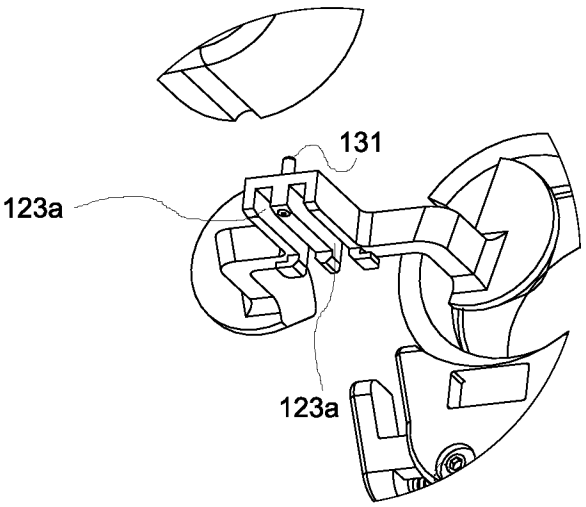
FIG. 2N is a close up view of the embodiment as shown in FIG. 2M.
Figure 2M:
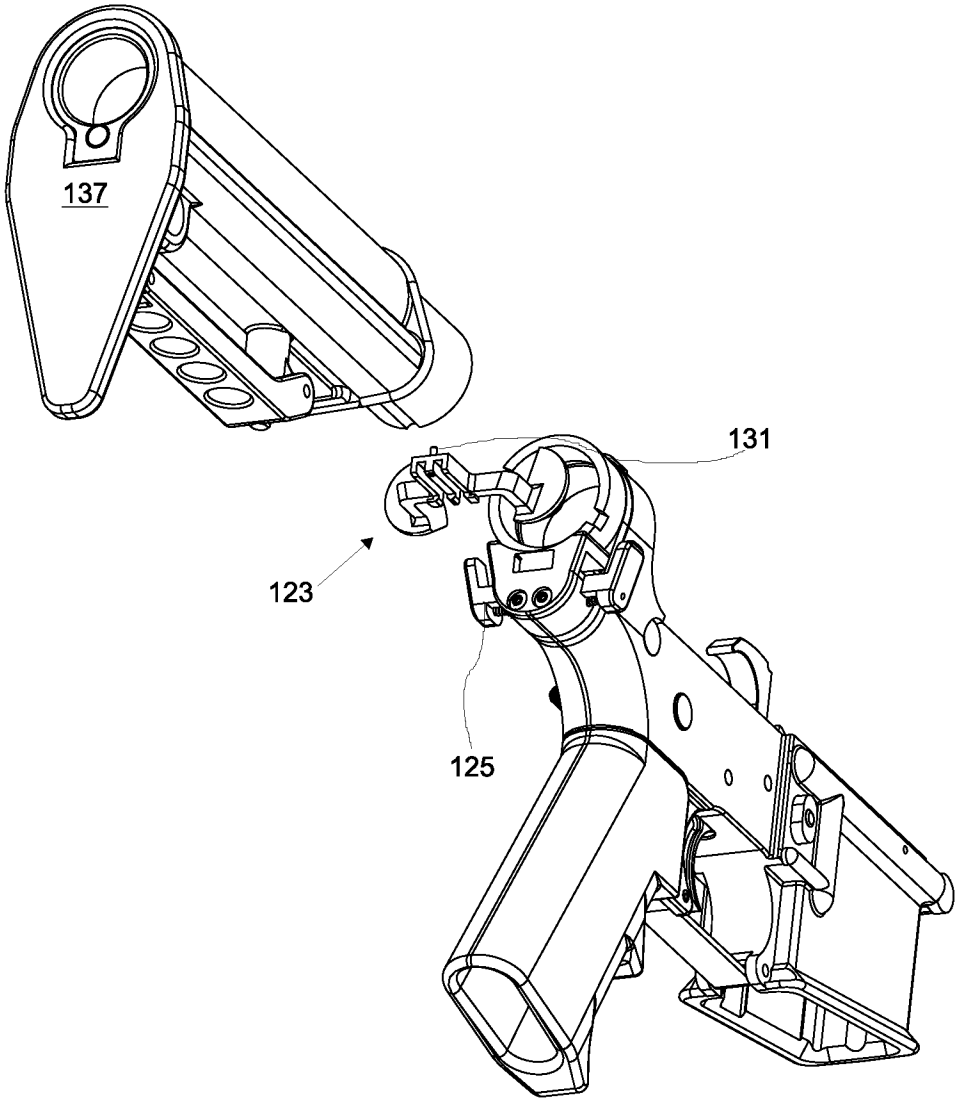
FIG. 2M is a partial isometric view of the embodiment as shown in FIG. 2L, showing an embodiment of an actuator in isolation from the actuator assembly.

In accordance with at least one aspect of this disclosure, referring additionally to FIGS. 2A-2N, a stock system 200 for a firearm (e.g., an AR-15 type or any other suitable firearm) can include any suitable embodiment of a buffer tube disclosed herein, e.g., buffer tube 100 as described above. The stock system 200 can include any suitable embodiment of a slide bar disclosed herein, e.g., slide bar 111 as described above, disposed within the slide bar channel 109 and configured to slide relative to the rail 105.

The system 200 can include an actuator assembly 121 having an actuator 123 operatively connectable or connected to the slide bar 111 to allow a user to move the slide bar 111 from the first position to the second position by moving the actuator 123 from an unactuated position (e.g., as shown in FIG. 2A) to an actuated position (e.g., as shown in FIG. 2G) when connected to the slide bar 111. The actuator 123 can be connected to the slide bar 111 in any suitable manner (e.g., integrally formed together, latched together, brazed together, screwed together, etc.). The system 200 can include a slide bar biasing member 115 disposed between the slide bar 111 and the rail 105 and/or the body 101 to bias the slide bar 111 toward the first position and thus biasing the actuator 123 toward an unactuated position.

In certain embodiments, the actuator assembly 121 can include a blocking member 125 configured to be moved between a blocking position (e.g., as shown in FIG. 2D) such that the actuator 123 is not moveable toward the actuated position and an unblocking position (e.g., as shown in FIG. 2F) such that the actuator 123 is moveable to the actuated position. The actuator assembly 121 can include a block biasing member (e.g., one or more springs) configured to bias the blocking member 125 to the blocking position (e.g., centered as shown).

In certain embodiments, e.g., as shown, the actuator 123 and the blocking member 125 can be configured to be accessible and actuatable from both sides of a grip 127 (e.g., a pistol grip shown attached to a lower receiver 129) of the firearm such that the actuator assembly 121 is usable by a right handed user or a left handed user. In certain embodiments, the actuator 123 and the blocking member 125 can be actuatable by a thumb of a user's gripping hand without the user having to remove the same hand from a grip 127 of the firearm and/or without removing a finger of the same hand from a trigger of the firearm.

Figure 3C:
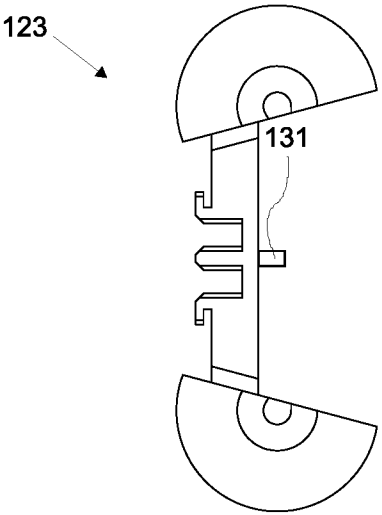
FIG. 3C is a front elevation view of the embodiment of FIG. 3A.
Figure 3A:
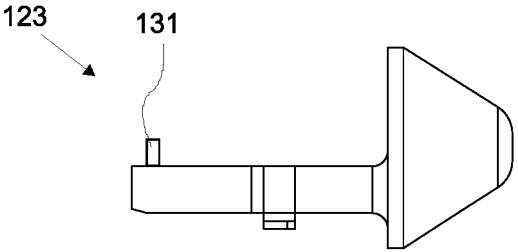
FIG. 3A is a side elevation of an actuator in accordance with this disclosure.
Figure 3B:
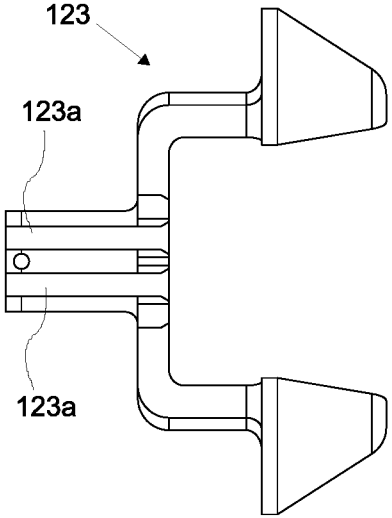
FIG. 3B is a bottom plan view of the embodiment of FIG. 3A.
Figure 4:
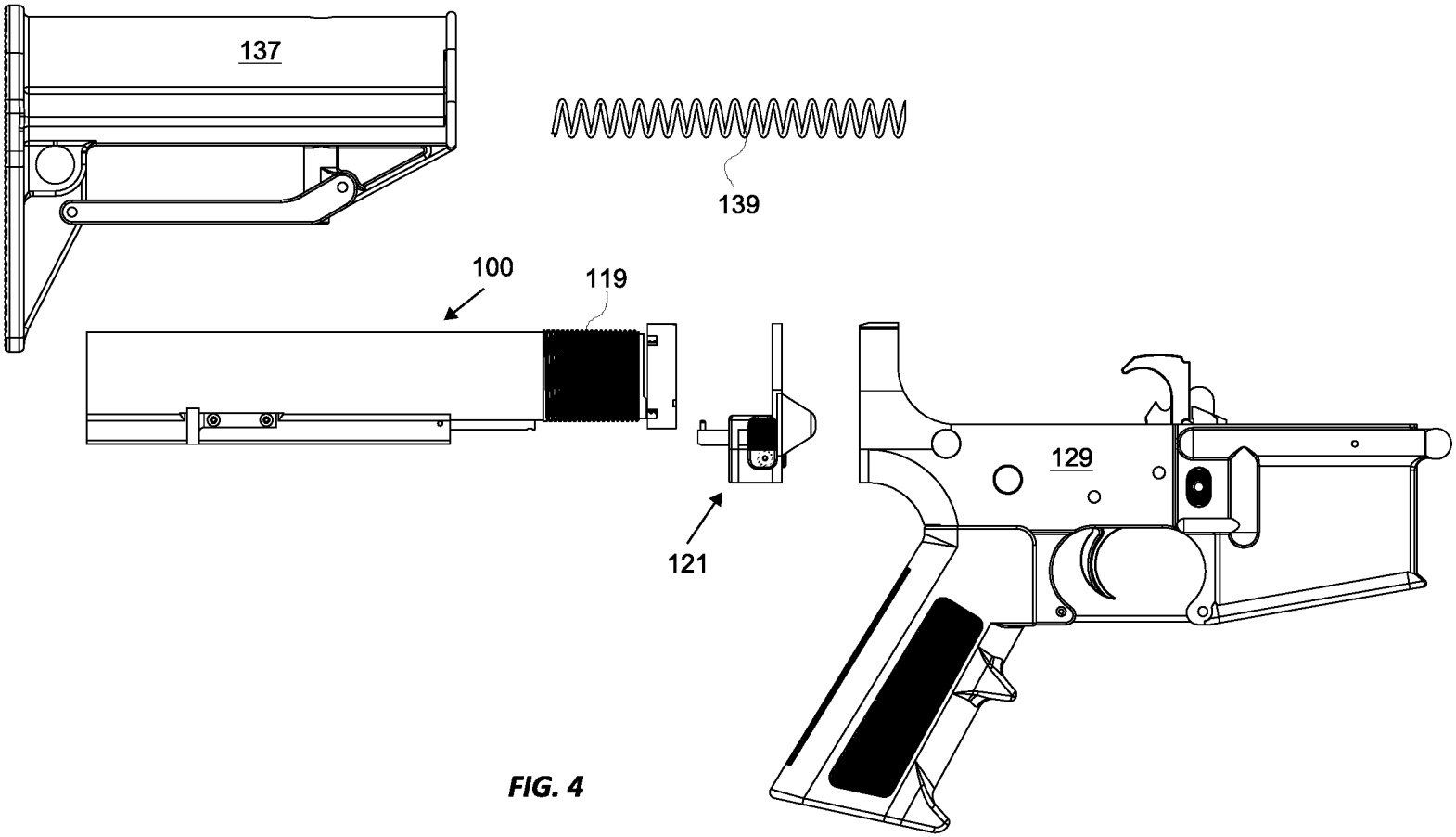
FIG. 4 is an exploded view of the embodiment of FIG. 2A in accordance with this disclosure.

Referring additionally to FIGS. 3A-4, in certain embodiments, the actuator 123 can include one or more blocking member channels 123*a* configured to receive a blocking post 125*a* of the blocking member 125 when the blocking member 125 is in the unblocking position. The actuator 123 can include a U shape and a central portion connected to the U shape, e.g., as shown. Any other suitable shape for the actuator is contemplated herein.

The actuator 123 can include a connector member 131 configured to connect to or connected to the slide bar 111 to allow the slide bar 111 to be pulled by the actuator 123. Any suitable connector member 131 (e.g., a post, a screw, an integral connection with the slide bar 111) is contemplated herein. In certain embodiments, the connector member 131 can be configured to insert into a connector hole in the slide bar 111 when installed on the firearm.

In certain embodiments, the system 200 can include a mounting plate 133 configured to be secured to the firearm by a castle nut 135, e.g., as shown, for example, or any other suitable fastener. The mounting plate 133 can be configured to attach to or is attached to the actuator assembly 121 (e.g., via one or more fasteners as shown in FIG. 2L) to mount the actuator assembly 121 to the firearm. As shown, the actuator assembly 121 can include a housing comprising one or more components configured to house the actuator 123 and/or the blocking member 125 therein. The housing can include one or more fastener holes configured to allow one or more fasteners to mount the housing to the mounting plate 133. Any suitable attachment to attach the actuator assembly 121 to the firearm is contemplated herein.

In certain embodiments, the system 200 can include a stock 137 slideably mountable to or slideably mounted to the buffer tube 100 and configured to move between a collapsed position (e.g., as shown in FIG. 2B) and an extended position (e.g., as shown in FIGS. 2H and 2J). The stock 137 can include any suitable form factor for a firearm stock.

The system 200 can also include a pin 113 disposed in the stock 137 and biased (e.g., with a pin spring as shown) in a direction that is radially inward to the buffer tube 100 such that the pin 113 is biased to a locked position (e.g., as shown in FIGS. 2C, 2E, and 2J) where the pin 113 is inserted into one of the one or more pin holes 107 preventing the stock 137 from sliding relative to the buffer tube 100, and an unlocked position (e.g., as shown in FIGS. 2G and 2H) where the pin 113 is outside of the one or more pin holes 107 and configured to slide with the stock 137 (e.g., in the trough 117) such that the stock 137 is allowed to slide relative to the buffer tube 100. Any suitable number of pins 113 and/or type of pins 113 are contemplated herein.

The system 200 can include one or more stock springs 139 disposed between the buffer tube 100 and the stock 137. The stock springs 139 can be configured to bias the stock 137 to the extended position. Any suitable number of stock springs 139 and/or position thereof (e.g., within the stock 137 and between the stock 137 and one or more stops 141 extending from the rail 105, a single spring within the stock 137 and between the stock 137 and a rear surface of the buffer tube 100).

Buffer tubes can include a cylindrical tube portion and a lower rectangular portion consisting of a multitude of linear holes. These holes can be designed to catch a plunger from a collapsible rifle stock. The stock can have a lower lever that when actuated, pulls the stock plunger from the occupied hole and the stock can then be manually moved by the rifleman to another of the holed positions by moving one of his hands from the rifle.

Embodiments can include an interior spring, which can be compressed by the rifle bolt upon cycling of the action. Embodiments can include a multitude of linear holes/teeth for the spring loaded collapsible plunger to engage. The canal can be cut on the bottom of the rectangular box which runs from the front to the rear and cuts directly through the multitude of linear holes/teeth. In that canal, a pull bar can be placed which has angled teeth, and those teeth can be located in a position that each tooth can be behind each linear hole.

The angle of each tooth can start from the bottom of the hole and can rise at an angle which can lift the stock plunger out of the hole. The front of the pull bar can have two levels, parallel to each other. The higher level can have a spring (e.g., a pull bar return spring) located between its front and the front of the rectangular box.

The lower level of the pull bar can have four, or any other suitable number, of screw holes allowing the attachment of a forward moving actuator. The actuator placed on either or both sides of the rifle grip can be positioned that it can be pushed forward from the firing hand while the rifleman can still hold the grip or fire the weapon if needed during actuator deployment.

The actuator (on either, or both sides) of the rifle can also have a sliding component which can require the rifleman to first push the (spring loaded) slider from the middle of the rear end plate located beneath the castle nut, in an outward direction, away from the center of the rear of the rifle. When the slider is moved perpendicular to the rifle, it can allow the forward pushing movement on the actuator(s) which then can pull the pull bar (located in the canal of the lower rectangular box lower buffer tube) in a forward motion.

As the pull bar moves forward, the multitude of teeth can simultaneously move from the solid portions of the buffer tube located between each stock plunger hole, into the hole. Whichever hole contains the plunger from the stock is then engaged from its bottom and the stock plunger is driven up out of the hole with the progression of the forward actuation. When the stock plunger is lifted entirely out of the hole/tooth, the stock then springs backward either to any of the further back holes/teeth (if controlled by the rifleman's shoulder or all the way back to the rear hole/tooth where a secondary stop spot eliminates the possibility of the stock to come off of the buffer tube.

The spring action pushing the stock to the rear can be from a spring positioned between the rear of the buffer tube and the front of the rifle stock's butt plate, for example. When the forward moving actuator is released, the spring at the front of the pull bar can cause the forward moving actuator to move rearward to its initial position, the pull bar can return to its rearward initial position (placing the teeth into the solid locations located between the plunger holes/teeth), and the perpendicular slider(s) located on the actuators can return to their initial position behind the rear end plate.

Embodiments of a buffer tube release the moving portion of the stock freely to multiple positions while the rifleman can keep both of his hands on the weapon for potential engagements.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The articles "a", "an", and "the" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

Any suitable combination(s) of any disclosed embodiments and/or any suitable portion(s) thereof are contemplated herein as appreciated by those having ordinary skill in the art in view of this disclosure.

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. A firearm structure, comprising:

a body configured to attach to or forming part of the firearm;

a rail disposed on or formed from an outer surface of the body, the rail comprising one or more pin holes configured to receive a pin of a stock to lock the stock in a position; and a slide bar channel defined through at least a portion of the rail and configured to allow a slide bar to slide therein relative to the one or more pin holes to urge a pin out of a respective pin hole and to block a pin from being received by the pin holes.

2. The structure of claim 1, wherein the rail extends radially outward from the body.

3. The structure of claim 2, wherein the one or more pin holes include a plurality of pin holes defined in a radial direction in the rail.

4. The structure of claim 3, wherein the slide bar channel opens at an outward face of the rail at least along a portion of an axial length thereof such that the slide bar channel connects a plurality of the pin holes.

5. The structure of claim 4, wherein the slide bar channel opens at the outward face of the rail at least between a first pin hole and a last pin hole such that the slide bar channel connects all of the pin holes.

6. The structure of claim 1, further comprising the slide bar disposed within the slide bar channel and configured to slide relative to the rail, wherein the slide bar is configured to allow a pin to enter into the one or more pin holes in a first position, and wherein the slide bar is configured to urge a pin out of the one or more pin holes and/or to block a pin from entering the one or more pin holes when moved from the first position toward a second position.

7. The structure of claim 6, wherein the slide bar includes one or more teeth that define one or more pin pockets to receive a pin therein to allow a pin to enter into the one or more pin holes when the slide bar is in the first position.

8. The structure of claim 7, wherein the one or more teeth include a plurality of teeth defining a pin pocket for each of the one or more pin holes.

9. The structure of claim 7, wherein the one or more teeth include a ramp face such that when the slide bar is moved in a direction that causes a pin and the ramp face to contact, the ramp face urges the pin radially outward of the respective pin hole.

10. The structure of claim 7, further comprising a slide bar biasing member disposed between the slide bar and the rail and/or body to bias the slide bar to the first position.

11. The structure of claim 1, wherein the rail includes a trough defined therein, wherein the one or more pin holes are disposed within the trough, wherein the trough is configured to limit a position of the pin of the stock.

12. A firearm stock system, comprising:

a structure comprising:

a body configured to attach to or forming part of the firearm;

a rail disposed on or formed from an outer surface of the body, the rail comprising one or more pin holes configured to receive a pin of a stock to lock the stock in a position; and a slide bar channel defined through at least a portion of the rail;

a slide bar disposed within the slide bar channel and configured to slide relative to the rail, wherein the slide bar is configured to allow a pin to enter into the one or more pin holes in a first position, and wherein the slide bar is configured to urge a pin out of the one or more pin holes and to block a pin from entering the one or more pin holes when moved from the first position toward a second position; and an actuator assembly having an actuator operatively connectable or connected to the slide bar to allow a user to move the slide bar from the first position to the second position by moving the actuator from an unactuated position to an actuated position when connected to the slide bar.

13. The system of claim 12, further comprising a slide bar biasing member disposed between the slide bar and the rail and/or body to bias the slide bar toward the first position and thus biasing the actuator toward an unactuated position.

14. The system of claim 13, wherein the actuator assembly includes a blocking member configured to be moved between a blocking position such that the actuator is not moveable toward the actuated position and an unblocking position such that the actuator is moveable to the actuated position.

15. The system of claim 14, wherein the actuator assembly further includes a block biasing member configured to bias the blocking member to the blocking position.

16. The system of claim 15, wherein the actuator and the blocking member are configured to be accessible and actuatable from both sides of a grip of the firearm such that the actuator assembly is usable by a right handed user or a left handed user, and wherein the actuator and the blocking member are actuatable by a thumb of a user's gripping hand without the user having to remove the same hand from a grip of the firearm and/or without removing a finger of the same hand from a trigger of the firearm.

17. The system of claim 15, wherein the actuator includes one or more blocking member channels configured to receive a blocking post of the blocking member when the blocking member is in the unblocking position.

18. The system of claim 12, wherein the actuator includes a connector member configured to connect to or connected to the slide bar to allow the slide bar to be pulled by the actuator.

19. The system of claim 12, further comprising a mounting plate configured to be secured to the firearm by a castle nut, wherein the mounting plate is configured to attach to or is attached to the actuator assembly to mount the actuator assembly to the firearm.

20. The system of claim 12, further comprising:

a stock slideably mountable to or slideably mounted to the structure and configured to move between a collapsed position and an extended position;

a pin disposed in the stock and biased in a direction that is radially inward to the structure such that the pin is biased to a locked position where the pin is inserted into one of the one or more pin holes preventing the stock from sliding relative to the structure, and an unlocked position where the pin is outside of the one or more pin holes and configured to slide with the stock such that the stock is allowed to slide relative to the structure; and one or more stock springs disposed between the structure and the stock and configured to bias a the stock to the extended position.

* * * * *